United States Patent [19]

Conner

[11] Patent Number: 4,986,548

[45] Date of Patent: Jan. 22, 1991

[54] BODY BALL TAG GAME

[76] Inventor: Dock L. Conner, 59 Devon Ct., Apt. 2, Edwardsville, Ill. 62025

[21] Appl. No.: 401,771

[22] Filed: Sep. 1, 1989

[51] Int. Cl.[5] ..... A63B 67/00

[52] U.S. Cl. ..... 273/346; 273/DIG. 30

[58] Field of Search ..... 273/346, 347, 349, 359, 273/412, DIG. 17, DIG. 18, DIG. 19, DIG. 30; 2/48, 88, 102

[56] References Cited

U.S. PATENT DOCUMENTS

| | | | |
|---|---|---|---|
| 3,032,345 | 5/1962 | Lemelson | 273/346 |
| 3,479,027 | 11/1969 | Fryer | 273/1 G |
| 3,927,881 | 12/1975 | Lemelson et al. | 273/58 K |
| 3,999,748 | 12/1976 | Clarke | 273/346 |
| 4,017,076 | 4/1977 | Bai | 273/346 |
| 4,029,316 | 6/1977 | Clarke | 273/58 K |
| 4,147,353 | 4/1979 | Moore | 273/58 C X |
| 4,240,639 | 12/1980 | Boulton et al. | 273/346 |
| 4,718,677 | 1/1988 | Barnes | 273/412 |
| 4,735,420 | 4/1988 | Seidler | 273/412 |
| 4,743,030 | 5/1988 | Auer et al. | 434/327 X |

OTHER PUBLICATIONS

*Kick the Can,* p. 112, Received in PTO Jun. 6, 1984.

*Primary Examiner*—William H. Grieb
*Attorney, Agent, or Firm*—Don W. Weber

[57] ABSTRACT

A new type of projectile-target game is presented which involves a thrown projectile having a VELCRO pad on the outside and a ball tag uniform which is worn by a second participant. The ball tag uniform has front and rear sections which are secured to the front and back of a participant by tie down strips. The front and back sections have VELCRO hook targets on them. An optional lower back section also has a third VELCRO hook target attached to it. In playing the game, one person throws the ball at the targets located on the other participant. The other participant is "tagged" when the VELCRO pad ball sticks to the VELCRO hook target.

5 Claims, 2 Drawing Sheets

BODY BALL TAG GAME

BACKGROUND OF THE INVENTION

This invention relates generally to the field of games involving thrown projectiles, and more particularly to a game which involves throwing a ball at a target apron worn by another player. Since the object of the game is to avoid being hit by the ball, the particular invention disclosed herein differs from projectile-target games known to the art.

With the introduction of Velcro hook and pad fasteners, a number of games involving projectiles and targets have been created. Of particular interest are U.S. Pat. No. 4,718,677 for a throw and catch game and U.S. Pat. No. 4,017,076, which is a target game involving a VELCRO ball and a hand-held target. In each of these inventions, the object of the game is for one person to throw a projectile consisting of a ball with VELCRO fasteners and the other participant to catch the thrown ball either by means of VELCRO pad fasteners on their arms or legs or a Velcro pad target held in the hand. Each of the above-described games develops hand-eye coordination as well as the coordination of the arms or legs. Each are basically designed for use by persons of all ages and the devices used to catch the projectile are not adaptable to vary as the age of the participants vary.

It is an object of this invention to provide a projectile and target for use by individuals of all ages. A specially designed attachment to the target apron adapts the target for use by smaller children. It is also an object of this invention to provide an adaptable ball tag apparatus and game for use by individuals of any age. It is another object of this invention to provide a game which develops upper body coordination as well as eye-torso coordination.

It is still a further object of this invention to provide a game which involves one participant dodging a projectile thrown by a second participant. Other and further objects of this invention will become obvious upon reading the following Specification.

BRIEF DESCRIPTION OF THE INVENTION

The body ball tag game is essentially an action game designed to be played by two or more participants. One or more participants wears a special VELCRO apron target uniform. One or more other participants throws a foam ball having a VELCRO jacket. One participant throws the ball at the other participant in an attempt to stick the ball to the targets on the apron target uniform. The primary objective of the game is to stick the ball to the opposing player's uniform. For older player with larger torsos, the Velcro apron target has an additional target located on the lower back of the player.

DETAILED DESCRIPTION OF THE PREFERRED EMBODIMENT

The apparatus used for playing this game consists of essentially two main parts. A foam ball 1 is thrown at a target area 2 in an attempt to stick the foam ball to the target area. Once the foam ball sticks to the target area, the players may then exchange roles.

Figure 4:
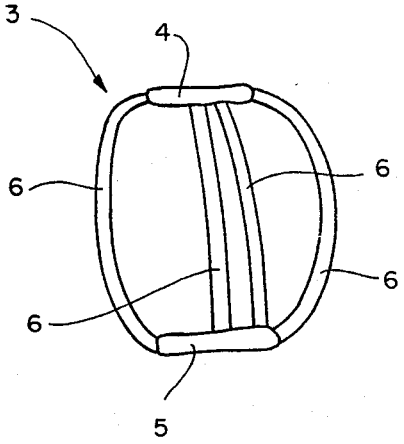
FIG. 4 is a front perspective view of the foam ball jacket showing the four horizontal strips and the top and bottom circular connecting pads.

The foam ball 1 is made up of a soft foam material and is approximately four inches (4") in diameter in the preferred embodiment. Detachably secured about the foam ball is a VELCRO pad jacket 3, as shown generally at FIG. 4. This VELCRO jacket comprises a top 4 and a bottom 5 essentially circular securing pad. Attached between these pads are a number of vertical strips 6. These strips, in the preferred embodiment, are approximately four inches (4") long and two inches (2") wide. The plurality of vertical strips are attached to the top and bottom securing pads by means of sewing, stitching, or other suitable method of attachment. The VELCRO pad jacket 3 is made of a flexible material so that it may be easily attached around the foam ball 1. While the preferred projectile used in this game is a foam ball, the VELCRO jacket may also be attached about a plastic ball or other type of ball. The main factor limiting the choice of the ball to be used is that one must use a ball which is soft enough to be safely used in a ball tag game. In the preferred embodiment, four vertical strips are used on the ball. However, any number of VELCRO strips may be used on the ball. The fewer the number of vertical strips, the harder it would be to stick the ball to the apron target.

Figure 1:
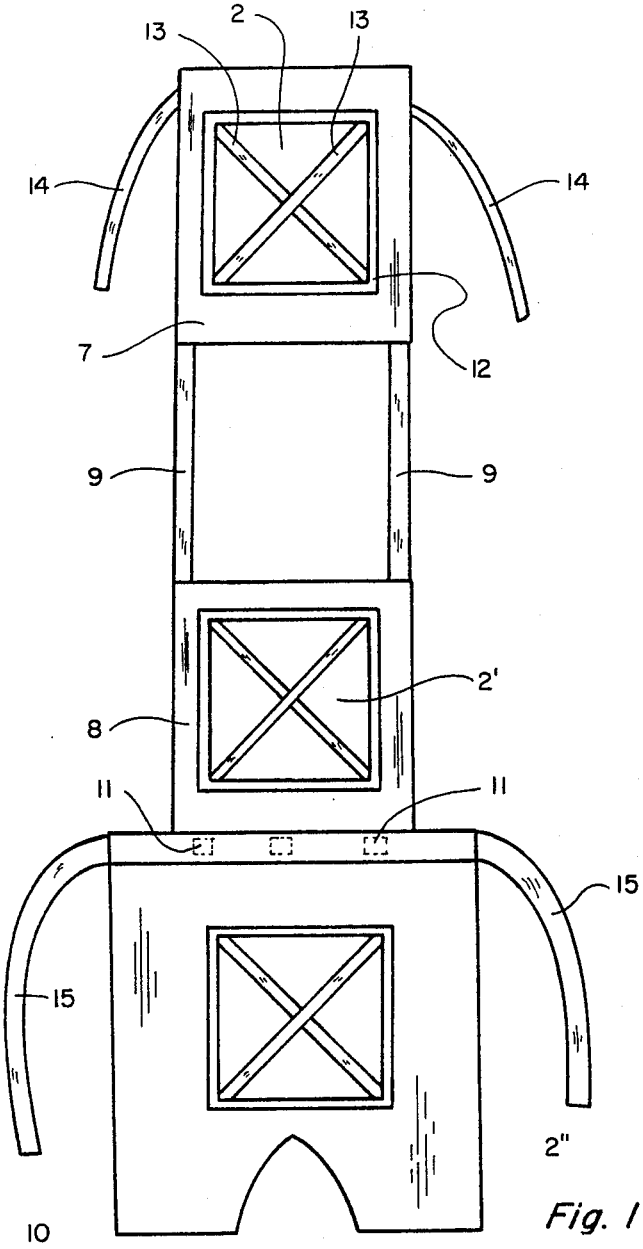
FIG. 1 is a top view of the target apron showing the front and rear panels and the lower back panel attached.
Figure 2:
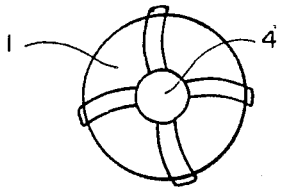
FIG. 2 is a top view of the foam ball with the Velcro ball jacket attached.
Figure 3:
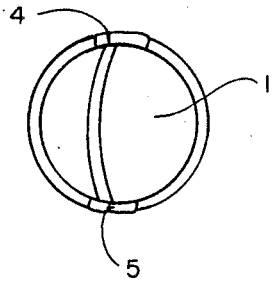
FIG. 3 is a side view of the foam ball showing three of the four horizontal strips on the ball.

The body ball tag uniform, shown generally on FIG. 1, is basically an apron-like garment which slips over the player's head and shoulders and covers the upper parts of the front and back body torso. The front section 7 and the rear section 8 are made up of a smooth lightweight material which is filled with a very lightweight foam padding. The outer material for the front and back apron sections may be made of vinyl plastic or any other suitable slick material. The only limitation on the outer material is that a VELCRO pad ball should not be able to adhere to the material. The front and back apron sections are filled with a very light foam padding for cushioning the blow of the projectile when it strikes the player.

The front and back apron sections are connected by means of shoulder straps 9. When the apron target is placed over the head and shoulders of the participant, a front target area 2 appears on the chest of the participant and a rear target area 2' appears on the back of the participant.

In the preferred embodiment, a third lower back apron section 10 is also attached. This lower back apron section 10 is attached beneath the back section 8 by means of Velcro hook and pad fasteners 11, snaps, buttons, or any other suitable detachable fasteners. The lower back apron section 10 has an irregular shape cut therefrom as best shown on FIG. 1. This lower back apron section is made of the same type of material and padding as are the front and back apron sections 7 and 8. Permanently attached to the outside of the lower back apron section is a lower back apron section target 2". These target areas, 2, 2' and 2", comprise an essentially square target area outline 12 and an "x" pattern target 13 inside the square target outline. The diagonal legs of each portion of the x-pattern target comprises a strip approximately three quarters of an inch (¾") wide. The x-pattern outline has a VELCRO hook surface towards the outside. The x-pattern is not flat between the diagonal edges of the square but is somewhat arched so as to project from the surface of the apron sections.

Figure 5:
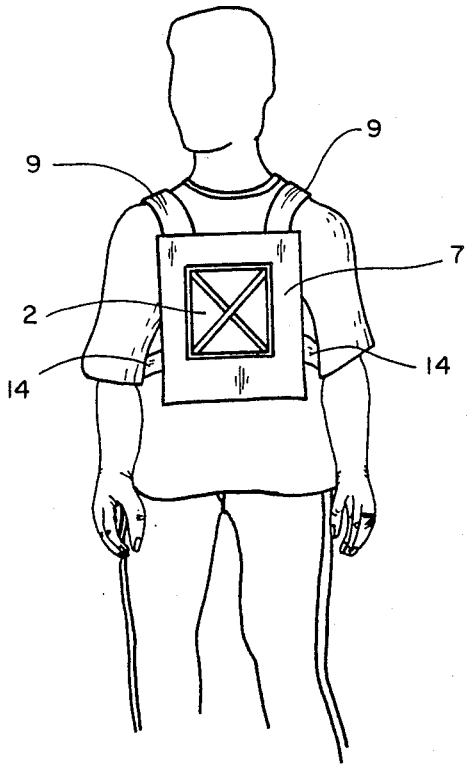
FIG. 5 is a front view of a participant wearing the target apron.
Figure 6:
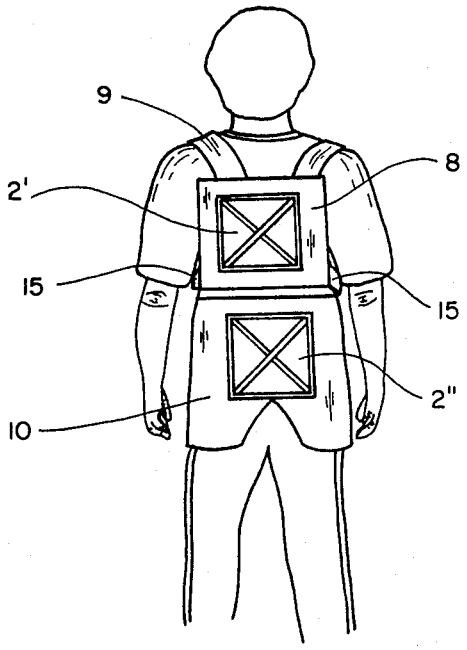
FIG. 6 is a back view of a participant wearing the target apron with the lower back torso target attached.

Attached to the front apron section is a plurality of tie down strings 14 as best shown on FIG. 1. Attached to the lower back apron section 10 in the preferred embodiment are similar rear tie down strings 15. When the body ball uniform is placed over the shoulders, as shown in FIGS. 5 and 6, the front and rear sections are fastened together by tying the front and rear tie down strings, as shown in drawing FIGS. 5 and 6. In another embodiment, the tie down strings are attached to the lower portion of the back apron section. In this second embodiment, the front and back apron sections may be secured to each other by these tie downs. However, in the preferred embodiment, the lower back apron section is attached to the back apron section as shown in the drawing figures and the front and rear tie down strings secure the ball tag uniform to the participant. At least one tie down string is attached to each side of the apron sections.

The front apron section of the uniform has been designed to cover the player's chest area and extends approximately from his shoulders to his waist. The front and back apron sections are approximately ten inches (10") square in the preferred embodiment. The target areas, 2, 2' and 2", are approximately four-and-one-half inches (4½") square and are located centrally on the outside of the apron sections. The lower back apron section 10 is approximately twelve inches (12") square, although the lower back apron section target area is the same size as the other target areas.

Obviously, the exact sizes of the apron sections and the target areas may vary without departing from the spirit of the instant invention. Similarly, the geometric shapes of the target area or the apron sections may vary while still being within the contemplation of the instant device. The back apron section extends essentially from a player's shoulders down his back to his waist area.

The lower back apron section, which is detachably connected to the back apron section as shown in the drawing figures, is designed to be detachable so that adjustment may be made for a smaller player. In normal use, the lower back apron section is attached to the back apron section to increase the number of targets. However, for smaller players, or to make the game itself more challenging, the lower back apron section may be removed leaving only the front and back apron section target areas.

The basic concept of the game is one in which one player throws the VELCRO pad ball at the other player who is wearing the body ball uniform. The target areas comprise VELCRO hook fasteners so that the Velcro pad ball will stick to the target areas when the ball is accurately thrown. The game develops upper body strength and torso coordination, as well as providing amusement for the participants.

Many variations in playing the game may be utilized. In the preferred embodiment, it is an object of the game for one participant to stick the ball to the VELCRO hook target. Once this is done, the person wearing the ball tag uniform is "tagged." Participants may then elect to continue the game with the same person throwing the projectile, or the participants may elect to switch positions with the original thrower now wearing the ball tag uniform.

The measurements and descriptions herein are meant as a means of illustration only and not as a means of limitation. As noted throughout the Specification, slight variations of geometric configurations or shapes may be made to the instant invention without departing from the spirit thereof.

Having fully described my new invention, I claim:

1. A ball tag game apparatus, comprising:

(a) a ball having a flexible VELCRO pad jacket;

(b) an apron having a front section covering a player's chest from his shoulders to his waist and at least one back section covering a player's back from his shoulders to his waist, each section having a VELCRO hook target area on the outside thereof, wherein said target area comprises an X-pattern of slightly arched VELCRO hook material;

(c) a pair of front tie-down string one attached to each side of said front section and a pair of back tie-down strings one attached to each side of said back section, whereby said apron may be secured in place about a player's torso;

whereby said ball may be thrown at and stuck to said target.

2. A ball tag game apparatus, as in claim 1, further comprising a lower back apron section for larger players detachably connected below said back sections having a VELCRO hook target area on the outside thereof, wherein said target area comprises an X-pattern of slightly arched VELCRO hook material.

3. A ball tag game apparatus as in claim 1, wherein said ball jacket is detachable.

4. A ball tag game apparatus as in claim 1, wherein said ball jacket comprises a plurality of vertical strips secured to a top and bottom essentially circular pad.

5. A ball tag game apparatus as in claim 1, wherein said target area comprises a square target outline and diagonal VELCRO hook strips.

* * * * *